United States Patent [19]

Hamilton et al.

[11] 4,115,124

[45] Sep. 19, 1978

[54] METHOD OF IMMOBILIZING OPTICAL BRIGHTENERS

[75] Inventors: Lewis R. Hamilton; Richard C. Sutton, both of Rochester, N.Y.

[73] Assignee: Eastman Kodak Company, Rochester, N.Y.

[21] Appl. No.: 503,816

[22] Filed: Sep. 6, 1974

[51] Int. Cl.[2] ..... G03C 1/92; G03C 1/94

[52] U.S. Cl. ..... 96/82; 96/84 R; 96/84 UV

[58] Field of Search ..... 96/82, 84 UV, 84 R

[56] References Cited

U.S. PATENT DOCUMENTS

| | | | |
|---|---|---|---|
| 2,673,153 | 3/1954 | Talbot | 96/82 |
| 3,181,950 | 5/1965 | Koerber et al. | 96/82 |
| 3,352,673 | 11/1967 | Graham | 96/84 A |
| 3,779,766 | 12/1973 | Tsuji et al. | 96/82 |

FOREIGN PATENT DOCUMENTS

| | | | |
|---|---|---|---|
| 43-10,254 | 4/1968 | Japan | 96/84 A |

*Primary Examiner*—Jack P. Brammer
*Attorney, Agent, or Firm*—Arthur H. Rosenstein

[57] ABSTRACT

The incorporation of polymers containing at least 80% by weight of substituted or unsubstituted poly(vinyl imidazole) in a photographic element containing fluorescent optical brighteners immobilizes the brighteners. The photographic elements resist loss of brightness due to photographic processing or washing.

25 Claims, No Drawings

METHOD OF IMMOBILIZING OPTICAL BRIGHTENERS

This invention relates to the use of substituted and unsubstituted poly(vinyl imidazoles) and copolymers comprising at least 80% by weight of the substituted or unsubstituted poly(vinyl imidazoles) as complexing agents to improve the fastness of anionic optical brighteners and U.V. absorbers in photographic elements.

The white areas of photographic prints and other products such as fibrous and plastic articles are often made to look whiter by incorporating optical brightening agents. The optical brightening agents fluoresce on irradiation with U.V. (ultraviolet) light, emitting visible light, usually bluish in hue thus enhancing the whiteness of the object. Optical brightening agents for use in photographic print materials must absorb U.V. light especially in the region from 360 to 400 mμ and efficiently convert this invisible light into visible light to enhance the whiteness and they must have the desired brightening power. The optical brighteners must also be stable to the temperatures as high as 310° to 330° C. used in incorporating them in plastics and in extruding the plastic materials in the desired form such as fibers, sheets, etc., if they are to be of any value in the finished product. Furthermore, the optical brighteners must be nonmigrating so that they remain in the plastic material where they are needed and do not exude as a surface film on the plastic which readily transfers to any other surface contacted with it.

A problem inherent in many of the prior art optical brightening agents is that they generally are unstable to light. Various methods of improving the light stability of brighteners include the preparation of dilute solid solutions of these brighteners in polymers having high glass transition temperatures such as disclosed in U.S. Pat. No. 3,684,729, issued Aug. 15, 1972 and U.S. application Ser. No. 847,404, filed Aug. 4, 1969, now abandoned. While this method improves light stability, it has been found to be necessary to use relatively large volumes of solvent in dispersion preparation. Also, the oleophilic layer is thick and when incorporated in a photographic paper, doctor wandering can be encountered in rawstock keeping and undesirable yellowing can occur on post-process high-humidity storage.

In order to avoid the above problems, water-soluble optical brighteners can be used. However, the water-soluble brighteners have a tendency to wander, especially during processing of the photographic element and water-washing. This decreases the brightness and fluorescence of the photographic element.

British Pat. No. 967,891 describes the application of polymers, such as water-soluble polyvinyl pyrrolidone in an overcoat layer of a photographic element to hold the optical brightener. However, this forms a matt surface on the photographic element. British Pat. No. 1,242,020 describes the use of polymers of vinylamides to hold the optical brighteners in photographic elements.

It is an object of this invention to provide photographic elements comprising fluorescent water-soluble optical brighteners wherein at least one layer comprises a polymer which increases the fastness of the optical brighteners to photographic processing and water washing.

A further object of this invention is to provide a method of stabilizing water-soluble fluorescent optical brighteners in photographic elements by incorporating into the elements polymers which will increase the fastness of the brighteners.

It has been found, according to the invention, that the incorporation of polymers comprising at least 80% by weight of substituted or unsubstituted poly(vinyl imidazoles) into a photographic element or composition comprising an anionic fluorescent optical brightener binds the brightener to the element or composition and inhibits the rinsing or bleeding of the brightener during photographic processing of water-washing.

The polymer in the described element or composition comprises at least 80% by weight of substituted or unsubstituted poly(vinyl imidazole). Substituted poly(vinyl imidazoles) included herein are, for example, poly(vinyl imidazoles) formed from the monomers described in U.S. Pat. No. 3,337,577, issued Aug. 22, 1967, such as, for example, poly(vinyl alkyl imidazoles) such as poly 2-methyl-1-vinyl-imidazole, 2-ethyl-1-vinyl-imidazole, 2 ethyl-4-methyl-1-vinyl imidazole, poly(vinyl aryl imidazole) such as 2-phenyl-1-vinyl-imidazole and the like.

Copolymers comprising at least 80% by weight of the substituted or unsubstituted poly(vinyl imidazole) are also useful. The vinyl imidazole can be copolymerized with other copolymerizable materials such as, vinylpyrrolidone, acrylamide, methacrylamide, including N-alkyl substituted acrylamide or methacrylamide wherein the alkyl substituent has 1 to 18 carbon atoms and can be interrupted with, or substituted with hetero atoms such as nitrogen, oxygen, or sulfur, or can be substituted with other groups such as oxo, alkyl, and the like, 2-acetoacetoxyethyl methacrylate or other active methylene containing monomers such as described in U.S. Pat. Nos. 3,459,790; 3,488,708; 2,865,893; 2,860,986 and 2,904,839; 4-vinyl and 5-vinyl pyridine; hydroxyalkyl acrylates or methacrylates wherein the alkyl portion contains from 1–3 carbon atoms such as hydroxyethyl acrylate and the like, acrylic acid, methacrylic acid, sulfonate monomers of the type described in U.S. Pat. No. 3,411,911 or sulfate monomers such as sodium methacryloyloxyethyl sulfate.

The polymer preferably has an inherent viscosity of from 0.2 to about 2.4 in methanol at 25° C. and at a concentration of 0.25 gram/deciliter of solution. The preferred polymers are poly(vinyl imidazole), poly(vinyl 2-methyl imidazole) and poly(vinyl imidazole-co-acrylamide) (90:10) wt. ratio.

The polymer is generally prepared by dissolving substituted or unsubstituted vinyl imidazole in a solvent such as benzene, or other organic solvent, water or water in combination with water miscible solvents such as acetone or alcohols and adding comonomers, if desired, and a polymerization initiator. Depending on the reaction medium, the polymerization catalysts or initiators can be water soluble and can be inorganic peroxide compounds such as persulphates, hydrogen peroxide or percarbonates, or preferably organic peroxide compounds, e.g., acyl peroxides such as benzoyl peroxide, alkyl peroxides such as tert-butyl hydroperoxide, lauroyl peroxide and cumyl hydroperoxide or dialkyl peroxides such as di-tert.-butyl peroxides. Redox systems which contain the aforementioned peroxide compounds, and, on the other hand, reducing agents which are based on acids of sulfur with sulfur in a low valency state such as pyrosulphite, bisulfite, sulphoxylates and alkanolamines can also be used. On the other hand, it is equally possible to use azo compounds of the type azobis(isobutyronitrile) or azodicarboxylic acid esters and the like as polymerization catalysts. These initiators can be employed in known quantities, i.e., from 0.1–5%, based on total monomers. The polymerization can be carried out within the temperature range of from about 20° to about 120° C. up to 72 hours.

The polymer can be incorporated in any layer of the photographic element. Thus, the polymer may be incorporated, for example, in a baryta layer, an undercoating, a light-sensitive emulsion layer, a protective layer or a diffusion transfer image-receiving layer coated on a support.

The anionic, water-soluble, fluorescent, optical brightening agent is one which emits fluorescence by absorbing ultraviolet rays. These optical brighteners are well known in the art and include stilbenes such as 4,4'-bis-(5,7-di-tert-amylbenzoxazol-2-yl)stilbene; 4,4'-bis-(4,6-dimethoxy-s-triazin-2-yl amino)stilbene; and the like; coumarins such as 7-diethylamino-4-methylcoumarin; 7-(4-chloro-6-N,N-diethylamino-s-triazin-2-yl amino)-3-phenylcoumarin; 3-phenyl-7-[2-dimethylaminoethyl)ureido]coumarin; 7-(4-acrylamido-6-N,N-diethylamino-s-triazin-2-yl amino)-3-phenylcoumarin; 7-acrylamido-3-phenylcoumarin and the like; thiophenes such as 2,5-dibenzoxazolyl thiophene; 2,5-bis(5,7-di-tert-amylbenzoxazol-2-yl)thiophene; 2,5-bis{2-[5-(1-methylpropyl)benzoxazolyl]}-thiophene; 6-ethylidenezoxazolylthiophene; and the like; and benzoxazoles such as 2,2'-[vinylenebis-(p-phenylene)]-benzoxazole; 2,2'-[vinylenebis-(p-phenylene)]-5,7-di-tert-amylbenzoxazole; and the like.

Examples of optical brighteners preferred herein are those having the general formulas:

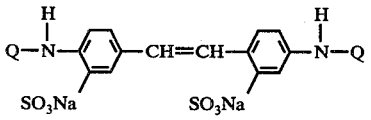

(I)

-continued

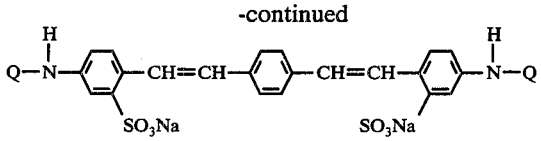

(II)

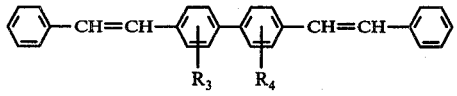

(III)

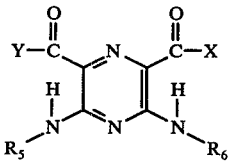

(IV)

wherein:

Q =

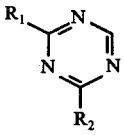

in which $R_1$ and $R_2$ represent hydrogen, halogen such as chloro, bromo and the like, hydroxy, alkoxy such as methoxy, a cycloalkyl radical such as cyclopentyl, cyclohexyl and the like, amino, alkylamino, dialkylamino, substituted anilino, and the like; $R_3$ and $R_4$ are water-solubilizing groups, such as carboxyl, hydroxyl, sulfo and sulfonamido; $R_5$ and $R_6$ represent an atom, group or radical with the definition given for $R_1$ and $R_2$; X and Y can be H, OH, NH, alkyl such as methyl, ethyl, butyl and the like, aryl such as phenyl, o-, m-, and p-carboxyphenyl hydroxyphenyl, sulphophenyl and the like.

Typical examples include:

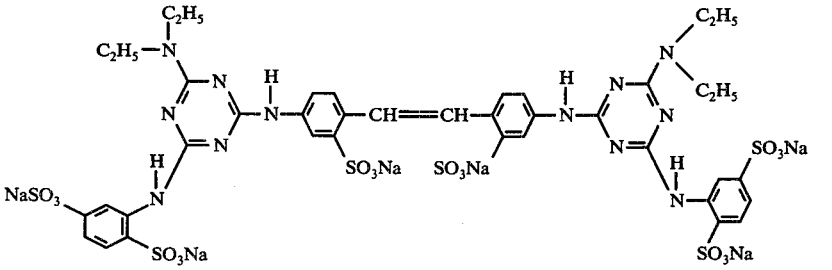

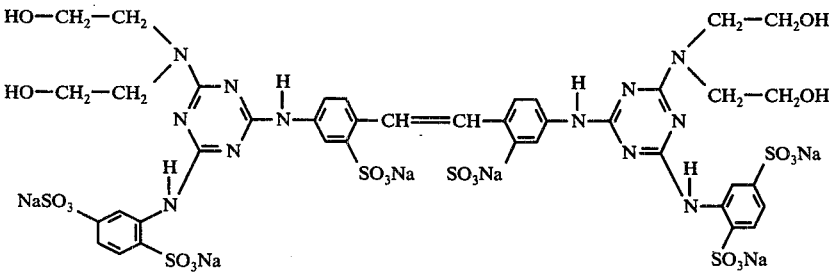

-continued

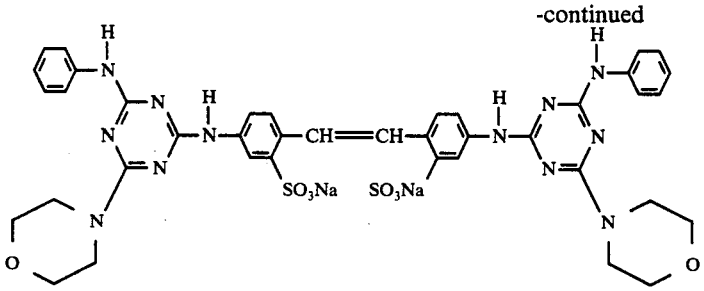

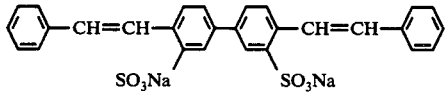

and

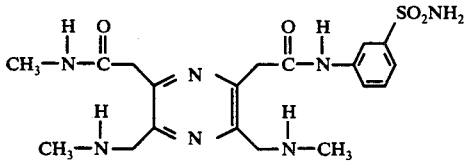

A further description of suitable optical brighteners useful in this invention can be found in British Pat. No. 1,242,020.

The brightener can be included in any layer in the photographic element; but generally in a layer comprising a hydrophilic binder. Binders with which the described brighteners are useful include both naturally occurring substances such as proteins, for example, gelatin, gelatin derivatives, cellulose derivatives, polysaccharides, such as dextran, gum arabic, and the like; and synthetic polymeric substances such as water-soluble polyvinyl compounds such as poly(vinyl pyrrolidone), acrylamide polymers and the like. Gelatin is a preferred binder.

The brightener generally comprises from about 3 milligrams/ft$^2$ to about 100 milligrams/ft$^2$ of support. The imidazole polymer comprises from about 3 to 300 milligrams/ft$^2$ of support.

Any of the conventional photographic support materials can be used advantageously for making photographic elements containing the described brightening agents and polymers. The include photographic paper supports, such as paper coated with a reflection pigment, e.g., barium sulfate, titanium dioxide, or zinc oxide, paper or other fibrous material coated with a hydrophobic resin, such as poly(ethylene terephthalate), polyethylene, polypropylene, poly(3-methylbutene-1), poly(octene-1), polyamides, polyacetals, polycarbonates, cellulose triacetate, cellulose acetate butyrate, and ethyl cellulose which are advantageously treated with corona discharge techniques just prior to coating the first gelatin layer over the resin such as described in U.S. Pat. Nos. 3,220,842, issued Nov. 30, 1965; 2,864,755, issued Dec. 16, 1958 and 2,864,756, issued Dec. 16, 1968; glass, conventional photographic film supports, such as poly(ethylene terephthalate), cellulose acetate, cellulose nitrate, and metal. Baryta is coated in the range from about 0.9 to 6.5 grams per square foot, preferably in the range from 1.8 to 5.6 grams per square foot.

Any hydrophilic colloid silver halide emulsions containing silver bromide, silver iodide, silver chloride, silver bromoiodide, silver chlorobromide, silver chlorobromoiodide, and the like, well known in photography are useful in the photographic elements according to the invention. The silver halide emulsion layers for color photographic elements advantageously contain color-forming couplers or are of the type that are color developed with color developer solutions containing the appropriate couplers.

Hydrophilic binders containing the described optical brightening agents can be located in a photographic element according to the invention wherever an ultraviolet absorbing brightener is needed. For example, the brightening agents can be in, over, or under a light-sensitive layer coated on any of the described supports, between two or more light-sensitive layers on any of the described supports, or in a layer containing a reflection pigment such as are described above. Brighteners according to the invention are particularly useful in photographic print materials, and in image-receiving elements for diffusion transfer.

In these processes, a light-sensitive diffusion transfer element containing a light-sensitive image exposed silver halide emulsion is processed with the exposed emulsion layer in contact with the silver precipitating layer of an image-receiving element in the presence of a silver halide developing agent, such as hydroquinone, 1-phenyl-3-pyrazolidone, p-methylaminophenol, a silver halide solvent or complexing agent, such as an alkali metal thiocyanate, ammonium thiocyanate, and the like. In a particularly useful process, a thickening agent, such as carboxymethylcellulose, or carboxyethylcellulose, is used. During development, undeveloped silver halide forms a complex with the complexing agent which diffuses in an imagewise manner to the silver-precipitating layer on the image-receiving element where a silver image is precipitated from the silver halide complex. In an integral element, a silver halide emulsion coated over a silver precipitating layer is removed such as by washing, to disclose the transferred image. In a color diffusion transfer process, an image-exposed light-sensitive silver halide color diffusion transfer element is contacted with the receiving layer of an image-receiving element in the presence of a developer solution which causes the release of a diffusible dye image that transfers to the mordanting receiving layer. The desired dye image remains in the receiving layer when the receiving element is separated from the developed diffusion transfer element. The diffusible dye image is formed from an incorporated non-diffusible coupler that couples with an imagewise pattern of oxidized primary aromatic amine color developing agent, produced by development of light-exposed silver halide. In another system, the dye image is formed from incorporated dye developing agents, such as hydroquinone derivatives that contain a chromophore as a substituent; the hydroquinone form of these compounds forms in the alkaline developer solution a diffusible dye while the dye developer that is oxidized to the quinone form (when it develops light-exposed silver halide to silver) is insoluble and does not diffuse to the image-receiving layer.

The polymers are advantageously used in image-receiving elements. The image-receiving elements generally comprise a support as described previously that has been coated in succession with (1) a baryta layer containing the brightening composition, and (2) an image-receiving layer for a silver image comprising any of the hydrophilic colloids such as have been described before, containing a dispersion of a silver precipitating agent or an image-receiving layer for a dye image comprising any of the hydrophilic colloids such as have been described before, containing a basic mordant for mordanting acid solubilized diffusible dyes. Usually, it is advantageous to have a hydrophilic resin layer between the baryta layer and the image-receiving layer. Hydrophobic resins that are advantageously used include poly(ethylene terephthalate), polyethylene, polypropylene, poly(3-methylbutene-1), poly(octene-1), poly(decene-1), polyamides, polyacetate, polycarbonates, cellulose triacetate, cellulose acetate butyrate, ethyl cellulose, etc.; preferably the hydrophobic resin layer is treated with corona discharge techniques just prior to coating the first hydrophilic colloid layer over the resin as described, for example, in U.S. Pat. Nos. 3,220,842, issued Nov. 30, 1965; 2,864,755, issued Dec. 16, 1958 and 2,864,756, issued Dec. 16, 1958. In one alternative structure, the baryta layer and brightening composition layers are coated separately between the support and image-receiving layer. In still another alternative structure, the image-receiving element comprises a support coated with a hydrophilic colloid layer containing both the brightening composition and a silver precipitating agent or mordant (for a dye transfer image).

The polymer can be incorporated into any of the layers above-described including the emulsion layer and the layer containing the brightener, but it is preferably incorporated in a layer contiguous to the layer containing the optical brightening agent.

A variety of known silver precipitants are useful in the described receiving layer. Examples of a useful silver precipitating agent and of image-receiving elements containing such silver precipitating agents, are described, for instance, in U.S. Pat. Nos. 2,698,237; 2,698,238 and 2,698,245 of Land, issued Dec. 28, 1954; U.S. Pat. No. 2,774,667 of Land and Morse, issued Dec. 16, 1956; U.S. Pat. No. 2,823,122 of Land, issued Feb. 11, 1958; U.S. Pat. No. 3,396,018, of Beavers et al., issued Aug. 6, 1968; and also U.S. Pat. No. 3,369,901, of Fogg et al., issued Feb. 20, 1968. The noble metals, such as silver, gold, platinum, palladium, and the like, in colloidal form are particularly useful.

Noble metal nuclei are particularly active and useful when formed by reducing a noble metal salt using a borohydride or hydrophosphite in the presence of a colloid as described in Rasch, U.S. Pat. No. 3,647,440, issued Mar. 7, 1972. The metal nuclei are prepared in the presence of a proteinaceous colloid such as gelatin and coated on the receiving element. The coating composition generally contains not only nuclei, but also reaction products which are obtained from reducing the metal salt.

The amount of colloid used in preparing the above active noble metal nuclei can be varied depending upon such factors as the particular colloid, reducing agent, and ratio of proportions. Typically, about 0.5% to about 20% by weight based on the total reaction mixture of colloid is used, preferably from about 1% to about 10%.

In a particularly useful embodiment, 30 to 80 mg. per square foot of the active noble metal nuclei in 80 mg. of colloid (solids basis) is coated per square foot of support. The colloid binder is advantageously coated in a range of about 5 to about 500 mg per square foot. Suitable concentrations on the receiving sheets of active noble metal nuclei as disclosed above can be about 1 to about 200 mg. per square foot. Other silver precipitants can be coated in a concentration of up to 5 mg per square foot.

A variety of known mordants that have a charge opposite to the charge of the dye being transferred are useful in the image-receiving elements for dye transfer images. Since most of the useful photographic image-transfer dyes have acidic solubilizing groups, basic or cationic mordants are generally used. Typical mordants are organic quaternary phosphonium salts, organic ternary sulfonium salts and organic quaternary ammonium salts. Suitable mordants include polymers of amino guanidine derivatives of vinyl methyl ketone described in Minsk, U.S. Pat. No. 2,882,156. Other suitable mordants include the 2-vinyl pyridine polymer metho-p-toluene sulfonate, poly 4-vinyl pyridine, thorium salts and similar compounds described in Sprague et al., U.S. Pat. No. 2,484,430.

The following examples are included for a further understanding of the invention.

EXAMPLE 1

Poly(vinylimidazole) was formed by the following procedure:

A reactor was charged with 17.25 liters of benzene. To the benzene was added 2300 g of N-vinylimidazole and the temperature was raised to 60° C. At that time, 20 g of 2,2'-azobis(2-methyl propionitrile) were added and the reaction was continued for 64 hours. The resulting coarse particles were filtered, pressed dry and dissolved in methanol at 20% concentration. The polymer was precipitated in a 12:1 dioxane-acetone solution and washed with acetone and dried in a vacuum to yield a polymer having an inherent viscosity of 0.97 in methanol.

A support was coated with 50 mg/ft$^2$ of a brightener having the formula:

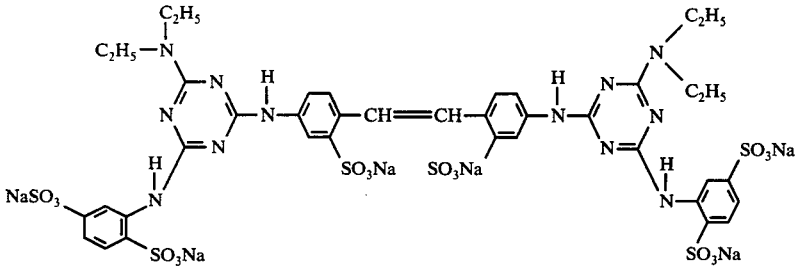

with 120 mg/ft$^2$ of the polymer. The brightener fastness was measured by recording the original optical density and optical density after conventional photographic processing and water washing. The original optical density was 2.30 and after a 30 minute water washing was 2.15 and after processing 1.70.

EXAMPLE 3

This is a comparative example.

The holding properties of the poly(vinyl imidazoles) of this invention were compared to the properties of prior art materials poly(vinyl pyrrolidone) by coating optical brighteners

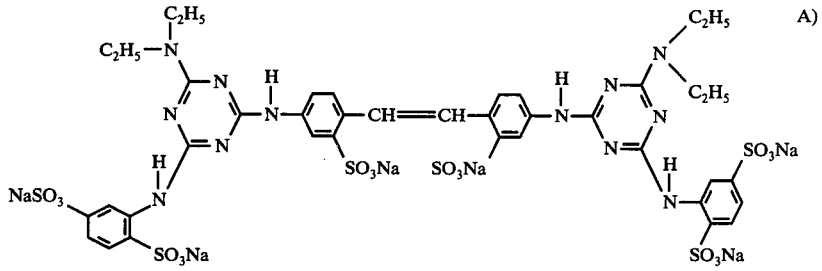

A)

and

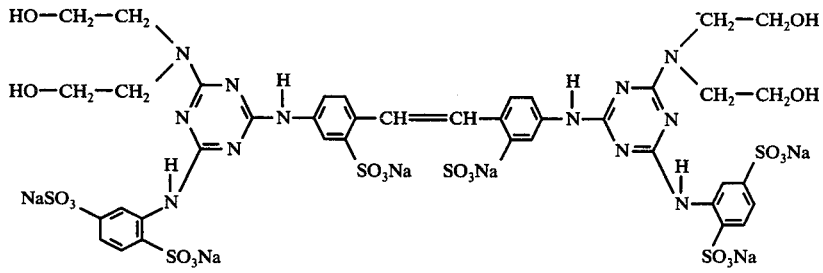

B)

EXAMPLE 2

The tests of Example 1 were repeated for the same element comprising 125 mg/ft.$^2$ of poly(vinyl-2-methylimidazole) in place of the poly(vinyl imidazole). The original optical density was 1.81 and after a 30 minute wash was 1.66; after a 24 hour wash was 1.50 and after complete photographic processing was 1.44.

on a support with a variety of non-ionic polymers at the following levels: brightener 10–100 mg/ft$^2$, polymer 63–250 mg/ft$^2$ and gelatin 100–500 mg/ft$^2$. The brightener fastness was monitored by recording the density at the absorption maximum (350–380 nm) as a function of photographic processing or wash time. The results are shown in Table 1.

TABLE 1

| | | | Optical Density at λmax | | | |
|---|---|---|---|---|---|---|
| Brightener | Polymer (mg/ft$^2$) | Gelating (mg/ft$^2$) | Original | after 30-min. wash | after 24-hour wash | after complete photog. process. |
| A | poly(vinyl-imidazole) (125) | 300 | 2.30 | 2.15 | 2.15 | 1.70 |
| A | poly(vinyl-2 methylimidazole) (125) | 300 | 1.81 | 1.66 | 1.50 | 1.44 |
| A | poly(vinyl pyrrolidone) K-60 (125) mol. wt. = 40,000 ave. | 300 | 1.83 | 0.28 | 0.12 | 0.30 |
| A | poly(vinyl pyrrolidone) K-60 (125) mol. wt. = | 300 | 1.82 | 0.20 | | 0.25 |

TABLE 1-continued

| Brightener | Polymer (mg/ft²) | Gelating (mg/ft²) | Optical Density at λmax | | | |
|---|---|---|---|---|---|---|
| | | | Original | after 30-min. wash | after 24-hour wash | after complete photog. process. |
| A | 160,000 poly(vinyl pyrrolidone) K-90 (125) | 300 | 1.84 | 0.12 | | 0.20 |
| A | None | 500 | 1.47 | 0.13 | | 0.14 |
| B | None | 500 | 1.47 | 0.13 | | 0.14 |
| B | poly(vinyl pyrrolidone) K-30 (250) mol. wt. = 40,000 ave. | 500 | 1.46 | 0.45 | | 0.42 |
| B | poly(vinyl-2-methyl-imidazole) (125) | 300 | 1.73 | 1.68 | 1.73 | 1.73 |
| B | poly(vinyl-imidazole) (125) | 300 | 1.94 | 1.90 | | 2.00 |

It is seen that the substituted and unsubstituted poly(-vinyl imidazoles) are superior to the prior art poly(vinyl pyrrolidone) polymers in retaining water soluble brightening agents in photographic elements.

The invention has been described in detail with particular reference to certain preferred embodiments thereof, but it will be understood that variations and modifications can be effected within the spirit and scope of the invention.

What is claimed is:

1. A photographic element comprising a support, at least one light sensitive emulsion layer, at least one layer containing an anionic water-soluble fluorescent optical brightener and a layer containing a polymer containing at least 80% by weight of poly(vinyl imidazole) or poly(vinyl imidazole) substituted with alkyl or aryl.

2. The photographic element of claim 1 wherein the polymer is a homopolymer of poly(vinyl imidazole).

3. The photographic element of claim 1 wherein the polymer is a homopolymer of poly(vinyl alkylimidazole).

4. The photographic element of claim 3 wherein the poly(vinyl alkylimidazole) is poly(vinyl-2-methylimidazole).

5. The photographic element of claim 1 wherein the polymer is a copolymer of at least 80% by weight of poly(vinyl imidazole) or poly(vinyl imidazole) substituted with alkyl or aryl and a member selected from the group consisting of vinyl acetate, vinyl pyrrolidone, vinyl pyridine, acrylamide, methacrylamide, 2-acetoacetoxyethyl methacrylate, hydroxyalkyl acrylate, hydroxyalkyl methacrylate, acrylic acid, methacrylic acid, sulfonates, sulfates, and active methylene containing monomers.

6. The photographic element of claim 1 wherein the polymer is a copolymer of at least 80% by weight of poly(vinyl imidazole) or poly(vinyl imidazole) substituted with alkyl or aryl and the remainder is acrylamide.

7. The photographic element of claim 1 wherein at least one light sensitive emulsion layer is a photographic silver halide layer.

8. The photographic element of claim 1 wherein the polymer is in a layer with gelatin.

9. The photographic element of claim 1 wherein the polymer comprises from about 3 mg/ft² to 300 mg/ft² of support.

10. The photographic element of claim 1 wherein the polymer is in an overcoat layer of the element and the optical brightener is in a layer intermediate the support and overcoat layer.

11. An integral receiver element comprising a support and at least one layer containing at least one photosensitive silver halide emulsion layer and on the same or different layer an anionic water-soluble fluorescent optical brightener and in the same or different layer a polymer containing at least 80% by weight of poly(vinyl imidazole) or poly(vinyl imidazole) substituted with alkyl or aryl.

12. A method of enhancing the brightness of a photographic element comprising a support, at least one light sensitive emulsion layer and at least one layer comprising an anionic water-soluble fluorescent optical brightener which comprises incorporating in the support or in one or more layers a polymer containing at least 80% by weight of poly(vinyl imidazole) or poly(vinyl imidazole) substituted with alkyl or aryl.

13. The method of claim 12 wherein the polymer is a homopolymer of poly(vinyl imidazole).

14. The method of claim 12 wherein the polymer is a homopolymer of poly(vinyl-2-methylimidazole).

15. The method of claim 12 wherein the polymer and optical brightener are incorporated into a gelatino-silver halide emulsion which is applied to a support.

16. The method of claim 12 wherein the optical brightener is incorporated in the support.

17. The method of claim 12 wherein the photographic element is a diffusion transfer element.

18. A photographic composition comprising an anionic water-soluble fluorescent optical brightener, a polymer containing at least 80% by weight of poly(vinyl imidazole) or poly(vinyl imidazole) substituted with alkyl or aryl and a gelatino silver halide photographic emulsion.

19. The composition of claim 18 wherein the polymer is a homopolymer of poly(vinyl imidazole).

20. The composition of claim 18 wherein the polymer is a homopolymer of poly(vinyl-2-methyl imidazole).

21. A photographic element comprising a support, at least one light sensitive emulsion layer, at least one layer containing an anionic water-soluble fluorescent optical brightener and in the same or different layer a polymer containing at least 80% by weight of poly(vinyl imidazole) or poly(vinyl imidazole) substituted with alkyl or aryl and containing up to 20% by weight of acrylamide.

22. A photographic element comprising a support, at least one light sensitive emulsion layer, at least one layer containing an anionic water-soluble fluorescent optical brightener and a layer containing a homopolymer of vinyl imidazole or vinyl imidazole substituted with alkyl or aryl.

23. An integral receiver element comprising a support and at least one layer containing at least one photosensitive silver halide emulsion layer and in the same or different layer an anionic water-soluble fluorescent optical brightener and in the same or different layer a homopolymer of vinyl imidazole or vinyl imidazole substituted with alkyl or aryl.

24. A method of enhancing the brightness of a photographic element comprising a support, at least one light sensitive emulsion layer and at least one layer comprising an anionic water-soluble fluorescent optical brightener which comprises incorporating in the support or in one or more layers a homopolymer of vinyl imidazole or vinyl imidazole substituted with alkyl or aryl.

25. A photographic composition comprising an anionic water-soluble fluorescent optical brightener, a homopolymer of vinyl imidazole or vinyl imidazole substituted with alkyl or aryl and a gelatino silver halide photographic emulsion.

* * * * *